US006641682B1

(12) United States Patent
Ide et al.

(10) Patent No.: US 6,641,682 B1
(45) Date of Patent: Nov. 4, 2003

(54) METHOD FOR MANUFACTURING AN APERTURE GRILL MATERIAL FOR COLOR PICTURE TUBE

(75) Inventors: Tsuneyuki Ide, Yamaguchi-ken (JP); Takahiko Miyazaki, Yamaguchi-ken (JP); Susumu Shigemasa, Yamaguchi-ken (JP); Yasuo Tahara, Yamaguchi-ken (JP)

(73) Assignee: Toyo Kohan Co., Ltd., Tokyo (JP)

( * ) Notice: Subject to any disclaimer, the term of this patent is extended or adjusted under 35 U.S.C. 154(b) by 0 days.

(21) Appl. No.: 09/979,989

(22) PCT Filed: May 31, 2000

(86) PCT No.: PCT/JP00/03516

§ 371 (c)(1),
(2), (4) Date: Apr. 15, 2002

(87) PCT Pub. No.: WO00/73525

PCT Pub. Date: Dec. 7, 2000

(30) Foreign Application Priority Data

May 31, 1999 (JP) ..... 11-152698

(51) Int. Cl.[7] ..... C21D 8/00; C21D 9/00
(52) U.S. Cl. ..... 148/651; 148/624
(58) Field of Search ..... 148/332, 333, 148/334, 335, 651, 624, 622

(56) References Cited

U.S. PATENT DOCUMENTS 5,413,623 A * 5/1995 Oonuki et al. ..... 75/508

FOREIGN PATENT DOCUMENTS

JP 408067945 A * 3/1996 ..... C22C/38/00

OTHER PUBLICATIONS

Abstract of JP 9–227998, Filed Sep. 2, 1997.
Abstract of JP 8–27541, Filed Jan. 30, 1996.
Abstract of JP 10–219397, Filed Aug. 18, 1998.
Abstract of JP 10–219396, Filed Aug. 18, 1998.
Abstract of JP 10–158789, Filed Jun. 16, 1998.

* cited by examiner

*Primary Examiner*—Deborah Yee
(74) *Attorney, Agent, or Firm*—Browdy and Neimark, P.L.L.C.

(57) ABSTRACT

An aperture grill material for a color picture tube having excellent tensile strength and high-temperature creep characteristics and magnetic characteristics superior to existing materials, a production method therefor, an aperture grill and a color picture tube. The aperture grill material for a color picture tube is characterized by being consisting of a low-carbon alloy steel sheet containing 0.05 to 2.5% by weight of Cu and 0.001 to 0.4% by weight of P, and containing 0.01 to 0.5% by weight of at least one of at least one of Cr and Mo. A production method for the aperture grill material for a color picture is characterized by comprising the steps of cold-rolling a low-carbon alloy hot-rolled steel strip containing 0.05 to 2.5% by weight of Cu, 0.001 to 0.4% by weight of P, and 0.01 to 0.5% by weight of at least one of Cr and Mo, and then precipitating the steel strip within a temperature range 300 to 800° C.

4 Claims, No Drawings

METHOD FOR MANUFACTURING AN APERTURE GRILL MATERIAL FOR COLOR PICTURE TUBE

TECHNICAL FIELD

This invention concerns an aperture grill material for a color picture tube, a manufacturing method thereof, an aperture grill and a color picture tube incorporating the same. More specifically, it relates to an aperture grill material for a color picture tube having excellent tensile strength and high temperature creep strength, as well as having excellent magnetic characteristics, a manufacturing method thereof, an aperture grill and a color picture tube incorporating the same.

BACKGROUND ART

Since an aperture grill for use in a color picture tube is welded to a frame in a state undergoing a large tension upon manufacture, it is necessary for the aperture grill material for use in the color picture tube to have a tensile strength of at least 60 kgf/mm$^2$. Accordingly, as the aperture grill material for use in the color picture tube used at present, low carbon steel sheets strengthened by applying working have been used.

Further, while a heat treatment is applied for blackening after welding to the frame, the heat treatment is conducted at 455° C. which is lower than the recrystallization temperature of steels in a short period of time for about 15 min in order to maintain each of the tapes constituting the aperture grill after blackening is kept in the state under tension without slackening. However, restoration is inevitable in the blackening heat treatment and restoration results in elongation of them, which causes twisting or disconnection of tapes. Accordingly, the aperture grill material for use in the color picture tube is required to have a tensile strength of 60 kgf/mm$^2$ or more, and result in no elongation under the blackening heat treatment at 455° C.×15 min, that is, have such a creeping strength that the elongation upon loading 30 kgf/mm$^2$ of tensile stress is 0.3% or less.

A color picture tube comprises electron guns and a fluorescent screen for converting electron beams into video images and the inside of the picture tube is covered with a magnetic shielding material for preventing the electron beams from being deflected by the geomagnetism. The aperture grill is also required to have a function as the magnetic shielding material and it has been demanded for a material having a large residual magnetic flux density (Br) and a small coercive force (Hc), that is, having a large ratio of the residual magnetic flux density to the coercive force (Br/Hc) as the magnetic characteristics. However, in the low carbon steel sheet which is applied with intense working for obtaining high yielding strength and the blackening heat treatment is conducted at a temperature lower than the recrystallization temperature, the residual magnetic flux density is as small as less than 8 kilo gauss (kG) and the coercive force is as large as 5 oersted (Oe) and, accordingly, Br (kG)/Hc (Oe) is as small as about 1.6, which is poor in the magnetic shield material.

Heretofore, the method of improving the tensile yield strength of the low carbon steel sheet includes, a solid-solution strengthening method with C or N but as the amount of C and N in the steel increases, carbides or nitrides increase to hinder the movement of magnetic walls to deteriorate the magnetic characteristics. Further, the method of improving the creep strength includes a method of precipitating carbide or the like in the steel but most of precipitates have a large grain size at the micron order and interfere the movement of magnetic walls to greatly deteriorate the magnetic characteristics, so that such methods have not been applied as the method of manufacturing current aperture grill materials for use in color picture tubes.

This invention has a subject of providing an aperture grill material for use in a color picture tube having excellent tensile strength and high temperature creep characteristics, as well as having more excellent magnetic characteristics than those of the existent materials, a manufacturing method thereof, an aperture grill and a color picture tube.

In order to solve the technical subjects, the present inventors have already proposed a low carbon alloy steel sheet with addition of Cu and P (Japanese Patent Application No. 36929/1997). The technical content is an aperture grill material provided with high strength and high creep strength by precipitating a fine Cu phase ($\epsilon$-phase) of nanometer (nm) order and by the combined use of solid-solution strengthening of P by the addition of P. Since precipitated Cu grains are extremely fine, they scarcely inhibit movement of the magnetic walls and the extent of deteriorating the magnetic characteristics is extremely small. Since P is solid-solubilized in Fe, it less inhibits the magnetic characteristics to obtain an aperture grill material having both high strength and magnetic characteristics. This invention has intended to further improve the creep strength on the basis of the prior art described above.

Disclosure of the Invention

The aperture grill material for a color picture tube according to this invention contains 0.05 to 2.5% by weight of Cu, 0.001 to 0.4% by weight of P, and further containing 0.01 to 0.5% by weight of at least one of Cr and Mo.

The aperture grill material for a color picture tube according to this invention contains 0.05 to 2.5% by weight of Cu, 0.001 to 0.4% by weight of P, 0.01 to 1.75% by weight of Ni, and further containing 0.01 to 0.5% by weight of at least one of Cr and Mo.

The aperture grill for use in a color picture tube according to this invention comprises a low carbon alloy steel sheet containing 0.05 to 2.5% by weight of Cu, 0.001 to 0.4% by weight of P, and further containing 0.01 to 0.5% by weight of at least one of Cr and Mo.

The aperture grill for use in a color picture tube according to this invention comprises a low carbon alloy steel sheet containing 0.05 to 2.5% by weight of Cu, 0.001 to 0.4% by weight of P, 0.01 to 1.75% by weight of Ni, and further contains 0.01 to 0.5% by weight of at least one of Cr and Mo.

A color picture tube according to this invention is incorporated with an aperture grill comprising a low carbon alloy steel sheet containing 0.05 to 2.5% by weight of Cu, 0.001 to 0.4% by weight of P, and further containing 0.01 to 0.5% by weight of at least one of Cr and Mo.

A color picture tube according to this invention is incorporated with an aperture grill comprising a low carbon alloy steel sheet containing 0.05 to 2.5% by weight of Cu, 0.001 to 0.4% by weight of P, 0.01 to 1.75% by weight of Ni, and further containing 0.01 to 0.5% by weight of at least one of Cr and Mo.

An aperture grill material for use in a color picture tube according to this invention has 0.3% or less of elongation when kept at 455° C.×15 min under loading a stress of 30 kgf/mm$^2$.

The aperture grill according to this invention, after being incorporated in a color picture tube, has an elongation of 0.6% or less when kept at 455° C.×15 min under loading a stress of 30 kgf/mm$^2$.

A color aperture grill material for use in a color picture tube according to this invention has a value for the ratio of the residual magnetic flux density (Br) and the coercive force (Hc): Br/Hc=1.8 or more as the magnetic characteristics.

The aperture grill according to this invention has a ratio of the residual magnetic flux density (Br) and the coercive force (Hc): Br/Hc=2.0 or more, as the magnetic characteristics after being assembled into the color picture tube.

A method of manufacturing an aperture grill material for use in a color picture tube according to this invention comprises cold rolling a low carbon alloy steel hot rolled strip containing 0.05 to 2.5% by weight of Cu, 0.001 to 0.4% by weight of P, and further containing 0.01 to 0.5% by weight of at least one of Cr and Mo and then applying a precipitation treatment within a temperature range from 300 to 800° C.

A method of manufacturing an aperture grill material for use in a color picture tube according to this invention comprising cold rolling a low carbon alloy steel hot rolled strip containing 0.05 to 2.5% by weight of Cu, 0.001 to 0.4% by weight of P, 0.01 to 1.75% by weight of Ni, and further containing 0.01 to 0.5% by weight of at least one of Cr and Mo and then applying a precipitation treatment within a temperature range from 300 to 800° C.

A method of manufacturing an aperture grill material for use in a color picture tube according to this invention comprises cold rolling a low carbon alloy steel hot rolled strip containing 0.05 to 2.5% by weight of Cu, 0.001 to 0.4% by weight of P, and further containing 0.01 to 0.5% by weight of at least one of Cr and Mo, applying an intermediate annealing within a temperature range from 500 to 900° C. and then applying secondary cold rolling and then applying a precipitation treatment within a temperature range from 300 to 750° C.

A method of manufacturing an aperture grill material for use in a color picture tube according to this invention comprises cold rolling a low carbon alloy steel hot rolled strip containing 0.05 to 2.5% by weight of Cu, 0.001 to 0.4% by weight of P, 0.01 to 1.75% by weight of Ni, and further containing 0.01 to 0.5% by weight of at least one of Cr and Mo and applying an intermediate annealing within a temperature range from 500 to 900° C., then applying secondary cold rolling and then applying a precipitation treatment within a temperature range from 300 to 750° C.

Best Mode for Practicing the Invention

The present inventors have already proposed in Japanese Published Unexamined Patent Application No. 219396/1998 that when fine Cu phase (ϵ-phase) at a nanometer (nm) order is precipitated by aging treatment in Cu-added ultra-low carbon steel and further solid-solution strengthening with P is used together by addition of P, high creep strength can be obtained and excellent magnetic characteristics of Br (kG) /Hc (Oe)≧2.5 or more can be obtained by the aging treatment. In this invention, the creep strength can be improved without greatly deteriorating the magnetic characteristics by adding at least one element selected from Cr and Mo in addition to the alloying ingredients of the low carbon alloy steel sheet described above.

This invention is to be explained more specifically.

The ultra-low carbon steel used as the material for the aperture grill for use in the color picture tube according to this invention is preferably decarbonized and denitrided by using a vacuum degassing method to decrease carbides and nitrides in the steel and promoted for the growth and crystal grains in the step of hot rolling or hot rolling or continuous annealing. Further, since carbides and nitrides dispersed finely in the steel hinder the movement of the magnetic walls to deteriorate the magnetic characteristics, it is necessary to previously restrict the elements contained in the steels and decrease them as less as possible. At first, the elements and the addition amount thereof to be added to the steel used for the aperture grill material for use in the color picture tube according to this invention are to be explained.

Regarding Cu, as already proposed above, as the addition amount increases, the precipitation amount of the ϵ-phase in the aging treatment increases to greatly increase the yield strength and the creep strength. Since the ϵ-phase comprise fine precipitates at the nanometer order, it does not hinder the movement of the magnetic walls to scarcely deteriorate the magnetic characteristics, different from the precipitates at the micron order. Accordingly, when the addition amount of Cu increases, the yield strength and the creep strength can be increased without deteriorating the magnetic characteristics. However, at the addition amount of less than 0.05% by weight, no sufficient effect for increasing the strength can be obtained. On the other hand, when the addition amount is excessive, precipitates are increased to deteriorate the magnetic characteristics, so that the addition amount is preferably 2.5% by weight or less.

Also regarding P, it is effective to improve the strength by solid-solution strengthening as has been already proposed and the solid-solution strengthening with P can be used in combination in addition to strengthening based on aging precipitation by Cu addition for greatly improving the tensile strength and the creep strength by the addition of P. A sufficient strength can be obtained already at an addition amount of 0.001% by weight or more but when the addition amount exceeds 0.4% by weight, mixed grains due to segregation occurs, so that the addition amount is defined as 0.4% by weight or less.

Regarding Cr, since Cr solid-solubilizes in steels to strengthen the steels by solid-solution and greatly increases tensile strength and creep strength, so that it can be used in combination with the solid-solution strengthening by P. A sufficient effect of improving the strength can be obtained at the addition amount of 0.01% by weight or more but carbides tend to be formed when the addition amount exceeds 0.5% by weight, so that the addition amount is defined as 0.5% by weight or less.

Regarding Mo, Mo like Cr solid solubilizes into steels to provide solid-solution strengthening of the steels and greatly increases tensile strength and creep strength. A sufficient effect of improving the strength can be obtained at the addition amount of 0.01% by weight or more but since carbides tend to be formed when the addition amount exceeds 0.5% by weight, the addition amount is defined as 0.5% by weight or less.

Regarding Cr and Mo, sufficient improvement for solid-solution strengthening can be expected even when they are added alone respectively and, when added simultaneously, a synergistic effect can be obtained and a sufficient strength can be obtained at the addition amount of 0.01% by weight or more but since formation of carbides increases as the addition amount exceeds 0.5% by weight, the addition amount is defined as 0.5% by weight or less.

Regarding C, when the C content is large, carbides are increased to inhibit movement of the magnetic walls and hinder the growth of the crystal grains leading to the deterioration of the magnetic characteristics. Since elements tending to form carbides are Cr, Mo and Fe each of which is a essential element in this invention, the content of C is desirably as low as possible. Accordingly, the upper limit for the C content is restricted to 0.01% by weight. The lower limit is as low as possible so long as it can be reduced practically by a vacuum degassing treatment.

Regarding Mn, Mn is chemically bonded with S in the steels to fix S contained in the steels as MnS, so that it has to be added in order to prevent hot brittleness but the addition amount is desirably as small as possible in order to improve the magnetic characteristics and the addition amount is defined as 0.5% by weight or less.

Since Si deteriorates the close adhesion of the blackened layer, the addition amount is defined as 0.3% by weight or less. S is preferably as less as possible in view of the crystal grain growth and the addition amount of 0.05% by weight or less is preferred. Further, since N is chemically bonded with Cr, Mo and Mn to form nitrides and hinders the magnetic characteristics, the content is preferably 0.05% by weight or less.

Then, a method of manufacturing a thin steel sheet as a material for an aperture grill for use in a color picture tube according to this invention is to be explained.

After hot rolling a ultra-low carbon steel containing the chemical compositions described above prepared by vacuum melting or vacuum degassing method, it was pickled to remove oxide layers formed in the hot rolling step. Successively, it is cold rolled to a sheet thickness of 0.035 to 0.2 mm. Then, it was applied with an aging treatment at a temperature from 300° C. to 800° C. for one min to 20 hrs. Since the recrystallization temperature increases in a case where the addition amount of Cu and P is large, the aging treatment may be conducted near 800° C. near the upper limit of the aging treatment but it is preferred to apply the aging treatment at a temperature from 450° C. to 700° C. considering the deposition amount and grain size of the precipitates of Cu. When the aging temperature is lower than 300° C., the ϵ-phase is not precipitated sufficiently failing to obtain necessary tensile strength and creep strength. On the other hand, when aging is applied at a temperature exceeding 800° C., it gives averaging in which ϵ-phase solid solubilized again in the steels to lower the tensile strength and the creep strength. For the aging treatment, any of box type annealing furnace or continuous annealing furnace may be used depending on the heating temperature and the heating time.

Further, as another embodiment, the ultra-low carbon steels described above may be hot rolled, pickled and cold rolled into a sheet thickness of 0.1 to 0.6 mm, then applied with intermediate annealing at a temperature from 500 to 900° C. to adjust the crystal grain size and then applied with a secondary cold rolling into a final sheet thickness of 0.035 to 0.2 mm and then applied with the aging treatment described above. When the annealing temperature is lower than 500° C., softening is insufficient and when the aging treatment is applied after the secondary cold rolling, the tensile strength and the creep strength are increased extremely. On the other hand, when the annealing temperature exceeds 900° C., no desired tensile strength can be obtained even when the aging treatment described above is applied after the secondary cold rolling.

EXAMPLE

This invention is to be explained more specifically by way of examples.

Slabs formed by melting 11 kinds of steels (A–K) of chemical compositions shown in Table 1 by vacuum degassing were hot rolled into hot rolled sheets of 2.5 mm thickness. After pickling the hot rolled sheets, they were cold rolled into two kinds of cold rolled sheets having a sheet thickness of 0.1 mm and 0.3 mm. Subsequently, aging treatment was applied directly to the cold rolled sheet of 0.1 mm sheet thickness, while an intermediate annealing was applied for the cold rolled sheet with a thickness of 0.3 mm. For the thus obtained test specimens, the residual magnetic flux density and the coercive force were measured under the magnetic field of 10 oersted using a convenient type Epstein magnetic measuring apparatus to determine Br(kG)/Hc(Oe). The creep strength was measured by using a creep tester (manufactured by Tokai Seisakusho) by loading a stress of 30 kgf/mm$^2$ in an atmospheric air and elongation (%) after keeping at 455° C. for 15 min in atmospheric air was measured and evaluated. Table 2 shows the conditions for the intermediate annealing and the aging treatment, as well as characteristics of the test specimens.

TABLE 1

Chemical composition of test specimens (steel sheets)

| Specimen | Chemical Composition (wt %) | | | | | | | | |
|---|---|---|---|---|---|---|---|---|---|
| No. | C | Mn | Si | S | Cu | P | Ni | Cr | Mo |
| A | 0.005 | 0.35 | 0.01 | 0.01 | 1.59 | 0.156 | 0.006 | 0.031 | 0.007 |
| B | 0.006 | 0.34 | 0.01 | 0.01 | 1.55 | 0.152 | 0.007 | 0.154 | 0.006 |
| C | 0.005 | 0.35 | 0.01 | 0.01 | 1.51 | 0.153 | 0.006 | 0.332 | 0.005 |
| D | 0.005 | 0.36 | 0.01 | 0.01 | 1.53 | 0.154 | 0.006 | 0.481 | 0.004 |
| E | 0.005 | 0.35 | 0.01 | 0.01 | 1.49 | 0.151 | 0.530 | 0.006 | 0.051 |
| F | 0.005 | 0.35 | 0.01 | 0.01 | 1.51 | 0.147 | 0.531 | 0.005 | 0.150 |
| G | 0.006 | 0.37 | 0.01 | 0.01 | 1.53 | 0.148 | 0.534 | 0.006 | 0.376 |
| H | 0.005 | 0.36 | 0.01 | 0.01 | 1.48 | 0.146 | 0.535 | 0.007 | 0.478 |
| I | 0.006 | 0.35 | 0.01 | 0.01 | 1.47 | 0.152 | 0.531 | 0.152 | 0.053 |
| J | 0.005 | 0.34 | 0.01 | 0.01 | 1.51 | 0.152 | 0.533 | 0.155 | 0.157 |
| K | 0.006 | 0.34 | 0.01 | 0.01 | 1.48 | 0.149 | 0.529 | 0.216 | 0.113 |

Note:
Balance being Fe and inevitable impurities

TABLE 2

| Condition for intermediate annealing and condition for precipitation treatment, and characteristics of test specimens | | | | | | | | |
|---|---|---|---|---|---|---|---|---|
| | | | | | Test items | | | |
| | Intermediate annealing condition | | Precipitation condition | | Characteristics for aperature grill material | | characteristics for aperature grill | |
| Specimen No. | Temp. (° C.) | Time (min) | Temp (° C.) | Time (min) | Magnetic characteristics Br/Hc (kG/Oe) | Creep elongation (%) | Magnetic characteristics Br/Hc (kG/Oe) | Creep elongation (%) |
| Reference value | — | — | — | — | 1.8 or more | 0.3% or less | 2.0 or more | 0.6% or less |
| A | 800 | 2 | 500 | 250 | 3.7 | 0.05 | 3.8 | 0.15 |
| B-1 | 800 | 2 | 500 | 250 | 2.8 | 0.03 | 3.1 | 0.14 |
| B-2 | — | — | 450 | 400 | 2.4 | 0.03 | 2.6 | 0.12 |
| C | 850 | 2 | 500 | 250 | 2.1 | 0.02 | 2.2 | 0.10 |
| D | 850 | 2 | 500 | 250 | 1.9 | 0.01 | 2.0 | 0.06 |
| E | 850 | 2 | 500 | 250 | 3.6 | 0.05 | 3.7 | 0.14 |
| F-1 | 800 | 2 | 500 | 250 | 2.7 | 0.03 | 3.0 | 0.13 |
| F-2 | — | — | 450 | 400 | 2.3 | 0.03 | 2.5 | 0.11 |
| G | 800 | 2 | 500 | 250 | 2.1 | 0.02 | 2.2 | 0.09 |
| H | 800 | 2 | 450 | 400 | 1.9 | 0.01 | 2.0 | 0.05 |
| I-1 | 800 | 2 | 550 | 120 | 2.3 | 0.03 | 2.4 | 0.10 |
| I-2 | — | — | 550 | 120 | 2.2 | 0.03 | 2.2 | 0.09 |
| J | 800 | 2 | 500 | 250 | 2.1 | 0.02 | 2.1 | 0.07 |
| K | 800 | 2 | 500 | 250 | 1.9 | 0.01 | 2.0 | 0.04 |

From Table 2, the aperture grill material and the aperture grill according to this invention has excellent characteristics.

Industrial Applicability

The aperture grill material and the aperture grill according to this invention can ensure high creep strength by precipitating the fine Cu phase (ϵ-phase) at the nanometer (nm) order by the aging treatment in ultra-low carbon steels with addition of Cu, or further adding P to use solid-solution strengthening of P together, can provide excellent magnetic characteristics of Br(KG)/Hc(Oe)≧1.8 or more and, further have excellent tensile strength and high temperature creep characteristic by the addition of at least one of elements selected from Cr and Mo without greatly deteriorating the magnetic characteristics.

What is claimed is:

1. A method of manufacturing an aperture grill material for use in a color picture tube, comprising:

cold rolling a low carbon alloy hot rolled steel band consisting of 0.05 to 2.5% by weight of Cu and 0.001 to 0.4% by weight of P, and further containing at least one of Cr and Mo in a total amount of 0.01 to 0.5% by weight and applying a precipitation treatment to the band within a temperature range from 300 to 800° C.

2. A method of manufacturing an aperture grill of a color picture tube, comprising cold rolling a low carbon alloy hot rolled steel strip containing 0.05 to 2.5% by weight of Cu, 0.001 to 0.4% by weight of P and 0.01 to 1.75% by weight of Ni, and further containing at least one of Cr and Mo in a total amount of 0.01 to 0.5% by weight, and precipitating the strip within a temperature range from 300 to 800° C.

3. A method for manufacturing an aperture grill material for use in a color picture tube comprising:

cold rolling a low carbon alloy hot rolled steel strip containing 0.05 to 2.5% by weight of Cu and 0.001 to 0.4% by weight of P, and further containing at least one of Cr and Mo in a total amount of 0.01 to 0.5% by weight;

applying an intermediate annealing step at a temperature range from 500 to 900° C.;

cold rolling a second time; and applying a precipitation treatment to the strip within a temperature range from 300 to 750° C.

4. A method of manufacturing an aperture grill material for use in a color picture tube comprising:

cold rolling a low carbon alloy hot rolled a strip containing 0.05 to 2.5% by weight of Cu, 0.001 to 0.4% by weight of P and 0.01 to 1.75% by weight of Ni, and further containing at least one of Cr and Mo in a total amount of 0.01 to 0.5% by weight;

applying an intermediate annealing at a temperature range from 500 to 900° C.;

cold rolling a second time, and applying a precipitation treatment within a temperature range from 300 to 750° C.

* * * * *